US009029305B2

(12) United States Patent
Narita

(10) Patent No.: US 9,029,305 B2
(45) Date of Patent: May 12, 2015

(54) LUBRICANT COMPOSITION AND CONTINUOUSLY VARIABLE TRANSMISSION

(75) Inventor: Keiichi Narita, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 465 days.

(21) Appl. No.: 12/812,860

(22) PCT Filed: Jan. 9, 2009

(86) PCT No.: PCT/JP2009/050211
§ 371 (c)(1),
(2), (4) Date: Nov. 18, 2010

(87) PCT Pub. No.: WO2009/090914
PCT Pub. Date: Jul. 23, 2009

(65) Prior Publication Data

US 2011/0053816 A1 Mar. 3, 2011

(30) Foreign Application Priority Data

Jan. 18, 2008 (JP) ..... 2008-009095

(51) Int. Cl.
*C10M 141/10* (2006.01)
*C10M 137/04* (2006.01)
*C10M 133/04* (2006.01)

(52) U.S. Cl.
CPC ..... *C10M 141/10* (2013.01); *C10M 2203/1006* (2013.01); *C10M 2215/04* (2013.01); *C10M 2223/04* (2013.01); *C10M 2223/049* (2013.01); *C10N 2230/06* (2013.01); *C10N 2240/046* (2013.01); *C10M 2207/026* (2013.01); *C10M 2207/289* (2013.01); *C10M 2209/084* (2013.01); *C10M 2219/046* (2013.01); *C10M 2219/106* (2013.01); *C10M 2223/047* (2013.01); *C10M 2227/02* (2013.01); *C10N 2240/045* (2013.01)

(58) Field of Classification Search
USPC ..... 508/433, 436, 441, 545, 408
See application file for complete search history.

(56) References Cited

U.S. PATENT DOCUMENTS

| | | | | |
|---|---|---|---|---|
| 5,380,508 | A * | 1/1995 | Inoue | 423/286 |
| 5,792,731 | A | 8/1998 | Ichihashi et al. | |
| 5,858,266 | A | 1/1999 | Kaneko | |
| 5,997,761 | A | 12/1999 | Kaneko | |
| 6,756,346 | B1 | 6/2004 | Baba et al. | |
| 6,797,679 | B2 * | 9/2004 | Kawasaki et al. | 508/272 |
| 2004/0167041 | A1 * | 8/2004 | Arimoto | 508/272 |
| 2006/0025314 | A1 * | 2/2006 | Henly | 508/273 |
| 2006/0229214 | A1 * | 10/2006 | Wu et al. | 508/279 |
| 2006/0252659 | A1 * | 11/2006 | Kinoshita et al. | 508/433 |
| 2007/0004603 | A1 | 1/2007 | Iyer et al. | |
| 2007/0155632 | A1 * | 7/2007 | Hata et al. | 508/258 |

FOREIGN PATENT DOCUMENTS

| | | |
|---|---|---|
| EP | 2 067 846 A1 | 6/2009 |
| GB | 1 460 921 | 1/1977 |
| JP | 11 180772 | 7/1989 |
| JP | 9 100487 | 4/1997 |
| JP | 9 137 181 | 5/1997 |
| JP | 10 8081 | 1/1998 |
| JP | 11 181464 | 7/1999 |
| JP | 2000 63866 | 2/2000 |
| JP | 2000 355695 | 12/2000 |
| JP | 2002 155292 | 5/2002 |
| JP | 2002 275489 | 9/2002 |
| JP | 2007 16233 | 1/2007 |
| JP | 2007 126543 | 5/2007 |
| WO | 96 11246 | 4/1996 |
| WO | WO 2007/052833 A1 | 5/2007 |
| WO | 2008 038701 | 4/2008 |

OTHER PUBLICATIONS

The Extended European Search Report issued Oct. 1, 2014, in Application No. / Patent No. 09701933.5-1352 / 2246412.

* cited by examiner

*Primary Examiner* — James Goloboy

(74) *Attorney, Agent, or Firm* — Oblon, McClelland, Maier & Neustadt, L.L.P.

(57) ABSTRACT

Provided is a lubricating oil composition containing a base oil which includes a mineral oil and/or a synthetic oil, and compounded therein, (A) at least one phosphorus-containing compound selected from phosphoric acid monoesters, phosphoric acid diesters and phosphorous acid monoesters, each having a $C_1$ to $C_8$ hydrocarbon group or groups and (B) a tertiary amine compound having $C_6$ to $C_{10}$ hydrocarbon groups as substituents thereof. The lubricating oil composition provides both a high metal to metal friction coefficient and an excellent wear resistance and is suitably used in a continuously variable transmission.

13 Claims, No Drawings

LUBRICANT COMPOSITION AND CONTINUOUSLY VARIABLE TRANSMISSION

This application is a 371 of PCT/JP09/50211, filed Jan. 9, 2009. Priority to Japanese patent application 2008-009095, filed Jan. 18, 2008, is claimed.

TECHNICAL FIELD

The present invention relates to a lubricating oil composition and, more specifically, to a lubricating oil composition which has a high metal to metal friction coefficient and an excellent wear resistance and which is suitable as a lubricating oil composition for a continuously variable transmission.

BACKGROUND ART

In recent years, metal belt type (push-belt type and chain type) or toroidal type continuously variable transmissions have been developed and practically used as transmissions for automobiles, etc. As a lubricating oil for such continuously variable transmissions, a lubricating oil for automatic transmissions was initially used. However, as continuously variable transmissions have been improved in their performance, lubricating oils for them have been also required to show an improved performance. In particular, lubricating oils for automatic transmissions are mainly required to provide optimized frictional characteristics of wet clutches. Therefore, when such lubricating oils for automatic transmissions are used for continuously variable transmissions, a metal to metal frictional coefficient is liable to be insufficient so that a problem is caused in that it is difficult to provide a large capacity of torque transmission.

In order to solve the afore-mentioned problem, lubricating oil compositions for continuously variable transmissions having a high metal to metal friction coefficient are developed. For example, Patent Document 1 discloses a lubricating oil composition in which a sulfur-based extreme pressure agent, a phosphorus-based extreme pressure agent and an alkaline earth metal-based detergent are compounded, Patent Document 2 discloses a lubricating oil composition which has a specific range of a friction coefficient and in which a metal salt-based detergent and a zinc dialkyldithiophosphate are compounded, and Patent Document 3 discloses a lubricating oil composition in which one or more of polymethacrylates, alkaline earth metal phenates and alkaline earth sulfonates are compounded together with an imide compound and a zinc alkyldithiophosphate. These lubricating oil compositions have a high metal to metal friction coefficient but have a problem in that, for example, wear resistance is reduced by corrosion.

Patent Document 4, on the other hand, discloses a lubricating oil composition in which at least one of phosphoric acid esters and phosphorous acid esters, at least one of thiophosphoric acid esters and thiophosphorous acid esters, and a polyamine compound are compounded. This lubricating oil composition is considered to have good wear resistance. However, the metal to metal friction coefficient thereof is desired to be further improved.

As described in the foregoing, the conventional lubricating oil compositions are not fully satisfactory with respect to achievement of both high metal to metal friction coefficient and excellent wear resistance and, therefore, are desired to be further improved in their performance.

[Patent Document 1] Japanese Patent Application Publication No. H9-100487

[Patent Document 2] Japanese Patent Application Publication No. H11-80772

[Patent Document 3] Japanese Patent Application Publication No. H11-181464

[Patent Document 4] Japanese Patent Application Publication No. 2002-155292

DISCLOSURE OF THE INVENTION

Problem to be Solved by the Invention

The present invention has been made in view of the above-described circumstance and is aimed at the provision of a lubricating oil composition which has both a high metal to metal friction coefficient and an excellent wear resistance and which may be suitably used in continuously variable transmissions.

Means for Solving the Problem

The present inventors have made an earnest study and, as a result, found that the above-described object can be accomplished by a lubricating oil composition in which a specific phosphorus-containing compound and a specific tertiary amine compound are compounded. The present invention is based on the above finding. Namely, the present invention provides:

(1) A lubricating oil composition comprising a base oil which comprises a mineral oil and/or a synthetic oil, and, compounded therein, (A) at least one phosphorus-containing compound selected from the group consisting of phosphoric acid monoesters, phosphoric acid diesters and phosphorous acid monoesters, each of which has a $C_1$ to $C_8$ hydrocarbon group and (B) a tertiary amine compound wherein substituents of the tertiary amine compound are $C_6$ to $C_{10}$ hydrocarbon groups;

(2) The lubricating oil composition as described in (1) above, wherein a phosphorus content of the phosphorus-containing compound of component (A) is 0.02% by mass or more based on the total mass of the lubricating oil composition;

(3) The lubricating oil composition as described in (1) above, wherein a nitrogen content of the tertiary amine compound of component (B) is 0.005% by mass or more based on the total mass of the lubricating oil composition;

(4) The lubricating oil composition as described in (I) above, wherein a mass ratio (phosphorus content: nitrogen content) of a phosphorus content of the phosphorus-containing compound of component (A) to a nitrogen content of the tertiary amine compound of component (B) is within a range of from 2:1 to 5:1;

(5) The lubricating oil composition as described in (1) above, wherein (C) at least one alkaline earth metal compound selected from the group consisting of alkaline earth metal sulfonates, alkaline earth metal phenates and alkaline earth metal salicylates is further compounded;

(6) A lubricating oil composition for a continuously variable transmission, comprising the lubricating oil composition as described in (1) to (5) above; and (7) A push belt type or chain type continuously variable transmission characterized by containing the lubricating oil composition for a continuously variable transmission as described in (6) above.

Effect of the Invention

According to the present invention, there is provided a lubricating oil composition which has both a high metal to metal friction coefficient and an excellent wear resistance. Because of the above-described characteristics, the lubricating oil composition may be particularly suitably used in continuously variable transmissions.

BEST MODE FOR CARRYING OUT THE INVENTION

The lubricating oil composition according to the present invention is one which comprises a base oil that comprises a mineral oil and/or a synthetic oil, and, compounded therein, a specific phosphorus-containing compound and a specific tertiary amine compound.

Base Oil:

As the base oil of the lubricating oil composition according to the present invention, a base oil including a mineral oil and/or a synthetic oil is used.

As the mineral oil, there may be mentioned, for example, paraffinic mineral oils, intermediate mineral oils and naphthenic mineral oils which are obtainable by ordinary refining processes such as solvent refining and hydrogenation refining.

As the synthetic oil, hydrocarbon-based synthetic oils and ether-based synthetic oils may be preferably used. Examples of the hydrocarbon-based synthetic oil include α-olefin oligomers, such as polybutene, polyisobutylene, 1-octene oligomer, 1-decene oligomer and ethylene-propylene copolymer, hydrogenation products thereof, alkylbenzenes and alkylnaphthalenes. Examples of the ether-based synthetic oils include polyoxyalkylene glycols and polyphenyl ethers.

Among the above-described base oils, mineral oils and hydrocarbon-based synthetic oils are preferably used as the base oil in the present invention.

As the base oil in the present invention, the above-described mineral oils may be used singly or in combination of two or more thereof. Also, the above-described synthetic oils may be used singly or in combination of two or more thereof. Further one or more of the mineral oils may be used in combination with one or more of the synthetic oils.

The viscosity of the base oil is preferably 1.5 to 35 $mm^2/s$, more preferably 2.5 to 8 $mm^2/s$ in terms of kinematic viscosity at 100° C.

The viscosity index of the base oil is preferably in the range of 80 to 140, more preferably in the range of 100 to 135.

Phosphorus-Containing Compound:

In the lubricating oil composition of the present invention, at least one phosphorus-containing compound selected from phosphoric acid monoesters, phosphoric acid diesters and phosphorous acid monoesters, each of which has a $C_1$ to $C_8$ hydrocarbon group, is used as component (A). When the carbon number exceeds 8, a high metal to metal friction coefficient is not obtainable and, further, the wear resistance is occasionally reduced.

As the $C_1$ to $C_8$ hydrocarbon group, there may be mentioned $C_1$ to $C_8$ alkyl groups, $C_2$ to $C_8$ alkenyl groups, $C_6$ to $C_8$ aryl groups and $C_7$ to $C_8$ aralkyl groups. The alkyl groups and alkenyl groups may be straight chained, branched or cyclic. Examples of such alkyl and alkenyl groups include a methyl group, an ethyl group, an n-propyl group, an isopropyl group, an n-butyl group, an isobutyl group, a sec-butyl group, a tert-butyl group, various pentyl groups, various hexyl groups, various heptyl groups, various octyl groups, a cyclopentyl group, a cyclohexyl group, an allyl group, a propenyl group, various butenyl groups, various hexenyl groups, various octenyl groups, a cyclopentenyl group and a cyclohexenyl group.

Examples of $C_6$ to $C_8$ aryl groups include a phenyl group, a tolyl group and a xylyl group. Examples of the $C_7$ to $C_8$ aralkyl group include a benzyl group, a phenethyl group and a methylbenzyl group.

Among the above-described hydrocarbon groups, $C_1$ to $C_8$ alkyl groups are preferred, $C_2$ to $C_8$ alkyl groups are more preferred, $C_4$ to $C_8$ alkyl groups are still more preferred.

The phosphoric acid monoester used in the present invention is an acid phosphate monoester represented by the following general formula (I).

(I)

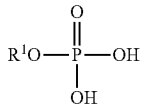

In the above formula (I), $R^1$ represents a $C_1$ to $C_3$ hydrocarbon group. Specific examples of the acid phosphate monoester include monoethyl acid phosphate, mono-n-propyl acid phosphate, mono-n-butyl acid phosphate and mono-2-ethylhexyl acid phosphate.

The phosphoric acid diester used in the present invention is an acid phosphate diester represented by the following general formula (II).

(II)

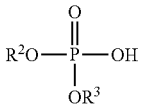

In the above formula (II), $R^2$ and $R^3$ each independently represent a $C_1$ to $C_8$ hydrocarbon group. Specific examples of the acid phosphate diester include diethyl acid phosphate, di-n-propyl acid phosphate, di-n-butyl acid phosphate and di-2-ethylhexyl acid phosphate.

The phosphorous acid monoester used in the present invention is an acid phosphite monoester represented by the general formula (III) below. The phosphorous acid monoester may also be a phosphorus-containing compound which is an isomer of the acid phosphite monoester and which has a structure represented by the general formula (IV) below.

(III)

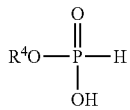

(IV)

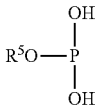

In the above formulas (III) and (IV), $R^4$ and $R^5$ each represent a $C_1$ to $C_8$ hydrocarbon group. Specific examples of the phosphorous acid monoester include ethyl acid phosphite, n-propyl acid phosphite, n-butyl acid phosphite and 2-ethylhexyl acid phosphite.

The phosphorous-containing compounds which are used as component (A) in the present invention may be used singly or in combination of two or more thereof. It is preferred that a phosphorus content of the phosphorus-containing compound is 0.02% by mass or more, more preferably 0.03 to 0.09% by mass, based on the total mass of the lubricating oil composition. When the phosphorus content is 0.02% by mass or more, the metal to metal friction coefficient may be improved.

Tertiary Amine Compound:

In the lubricating oil composition of the present invention, a tertiary amine compound having $C_6$ to $C_{10}$ hydrocarbon groups as substituents thereof is used as component (B). When the carbon number is less than 6, neither high metal to metal friction coefficient nor excellent wear resistance is obtainable. When the carbon number exceeds 10, neither high metal to metal friction coefficient nor excellent wear resistance is obtainable.

As the $C_6$ to $C_{10}$ hydrocarbon group, there may be mentioned, for example, $C_6$ to $C_{10}$ alkyl groups, $C_6$ to $C_{10}$ alkenyl groups, $C_6$ to $C_{10}$ aryl groups and $C_7$ to $C_{10}$ aralkyl groups. The alkyl and alkenyl groups may be straight chained, branched or cyclic and may be, for example, various hexyl groups, various heptyl groups, various octyl groups, various nonyl groups, various decyl groups, cyclohexyl groups, various hexenyl groups, various octenyl groups, various decenyl groups, a cyclopentenyl group or a cyclohexenyl group.

Examples of $C_6$ to $C_{10}$ aryl groups include a phenyl group, a tolyl group, a xylyl group and a naphthyl group. Examples of $C_7$ to $C_{10}$ aralkyl groups include a benzyl group, a phenethyl group, a methylbenzyl group and a methylphenethyl group.

Among the above-described hydrocarbon groups, $C_6$ to $C_{10}$ alkyl groups are preferred and $C_8$ alkyl groups are more preferred.

The tertiary amine compound used in the present invention may be represented by the following general formula (V).

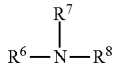

(V)

In the general formula (V), $R^6$, $R^7$ and $R^8$ each independently represent a $C_6$ to $C_{10}$ hydrocarbon group. Specific examples of the tertiary amine compound include trihexylamine, trioctylamine, tricyclohexylamine and tribenzylamine.

The tertiary amine compounds which are used as component (B) in the present invention may be used singly or in combination of two or more thereof. It is preferred that a nitrogen content of the tertiary amine compound is 0.005% by mass or more, more preferably 0.02 to 0.04% by mass, based on the total mass of the lubricating oil composition. When the nitrogen content is 0.005% by mass or more, the wear resistance may be improved.

In the present invention, a mass ratio (phosphorus content: nitrogen content) of a phosphorus content of the phosphorus-containing compound of component (A) to a nitrogen content of the tertiary amine of component (B) is within a range of from 2:1 to 5:1, more preferably within a range of from 3:1 to 4:1.

Alkaline Earth Metal Compound:

In the lubricating oil composition of the present invention, it is preferred that at least one alkaline earth metal compound selected from alkaline earth metal sulfonates, alkaline earth metal phenates and alkaline earth metal salicylates be compounded in addition to component (A) and component (B). When the alkaline earth metal compound is compounded, the metal to metal friction coefficient may be improved.

As the alkaline earth metal sulfonate, there may be mentioned alkaline earth metal salts of alkylaromatic sulfonic acids which are obtainable by sulfonating alkylaromatic compounds having a molecular weight of 300 to 1,500, preferably 400 to 700. Among such alkaline earth metal salts, magnesium salts and/or calcium salts, particularly calcium salts, are preferably used.

As the alkaline earth metal phenate, there may be mentioned alkaline earth metal salts of alkylphenols, alkylphenol sulfides and products obtainable by a Mannich reaction of alkylphenols. Among such alkaline earth metal salts, magnesium salts and/or calcium salts, particularly calcium salts, are preferably used.

As the alkaline earth metal salicylate, there may be mentioned alkaline earth metal salts, particularly magnesium salts and/or calcium salts, of alkylsalicylic acids. Among such alkaline earth metal salts, calcium salts are particularly preferably used.

The alkaline earth metal compound preferably has a straight chained or branched alkyl group which has a carbon number of 4 to 30, more preferably 6 to 18. As the alkaline earth metal compound, there may be used any of neutral salts, basic salts and perbasic salts. A total basic number of the alkaline earth metal compound is generally 10 to 500 mgKOH/g, more preferably 15 to 450 mgKOH/g.

The alkaline earth metal compound may be compounded in an amount of 0.01 to 20% by mass, preferably 0.1 to 10% by mass, based on the total mass of the lubricating oil composition. When the compounding amount is 0.01% by mass or less, it is hard to achieve an effect of the addition thereof. No additional effect may be obtained even when the compounding amount exceeds 20% by mass. The alkaline earth metal compound may be used singly or in combination of two or more thereof as long as the using amount is within the above specified range.

Other Additives:

The lubricating oil composition for continuously variable transmissions according to the present invention may be further compounded with an additive or additives as long as the object of the present invention is not adversely affected. Example of the additive include an antioxidant, an ashless detergent dispersant, a viscosity index improver, a pour point depressant, a rust preventive agent, a metal deactivator, deformer and a friction modifier.

As the antioxidant, there may be used a hindered phenol type antioxidant, an amine type antioxidant or a zinc alkyldithiophosphate (ZnDTP) antioxidant. Examples of the hindered phenol type antioxidant include: 4,4'-methylenebis(2,6-di-t-butylphenol); 4,4'-bis(2,6-di-t-butylphenol); 4,4'-bis(2-methyl-6-t-butylphenol); 2,2'-methylenebis(4-ethyl-6-t-butylphenol); 2,2'-methylenebis(4-methyl-6-t-butylphenol); 4,4'-butylidenebis(3-methyl-6-t-butylphenol); 4,4'-isopropylidenebis(2,6-di-t-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-t-butyl-4-methylphenol; 2,6-di-t-butyl-4-ethylphenol; 2,4-dimethyl-6-t-butylphenol; 2,6-di-t-amyl-p-cresol; 2,6-di-t-butyl-4-(N,N'-dimethylaminomethylphenol); 4,4'-thiobis(2-methyl-6-t-butylphenol); 4,4'-thiobis(3-methyl-6-t-butylphenol); 2,2'-thiobis(4-methyl-6-t-butylphenol); bis(3-methyl-4-hydroxy-5-t-butylbenzyl) sulfide; bis(3,5-di-t-butyl-4-hydroxybenzyl) sulfide; n-octadecyl-3-(4-hydroxy-3,5-di-t-butylphenyl) propionate; and 2,2'-thio [diethyl-bis-3-(3,5-di-t-butyl-4-hydroxyphenyl)-propionate]. Above all, those of bisphenol type and ester group-containing phenol type are particularly preferred.

As the amine type antioxidant, there may be mentioned, for example, those of a monoalkyldiphenylamine type, such as monooctyldiphenylamine and monononyldiphenylamine; those of a dialkyldiphenylamine type, such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, 4,4'-dinonyldiphenylamine; those of a polyalkyldiphenylamine type, such as tetrabutyldiphenylamine, tetrahexyldiphenylamine, tetraoctyldiphenylamine and tetranonyldiphenylamine; and those of naphthylamine type such as α-naphthylamine, phenyl-α-naphthylamine and alkyl-substituted phenyl-α-naphthylamines, e.g. butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. Above all, those of dialkyldiphenyl amine type and naphthylamine type are preferred.

As the ashless detergent dispersant, there may be mentioned, for example, succinimides, boron-containing succinimides, benzylamines, boron-containing benzylamines, succinic acid esters and amides of monobasic or dibasic carboxylic acids typified by fatty acids and succinic acid. As the viscosity index improver, there may be mentioned, for example, polymethacrylates, dispersed polymethacrylates, olefin-based copolymers (e.g., ethylene-propylene copolymer), dispersed olefin-based copolymers, and styrene-based copolymers (e.g., styrene-diene hydrogenated copolymer).

As the pour point depressant, there may be mentioned, for example, polymethacrylates having a weight average molecular weight is about 10,000 to about 150,000.

As the rust preventive agent, there may be mentioned, for example, metal sulfonates and succinic acid esters.

As the metal deactivator, there may be mentioned, for example, those of benzotriazole type, benzimidazole type, benzothiazol type and thiadiazole type.

As the deformer, there may be mentioned, for example, polysiloxanes and polyacrylates.

As the friction modifier, there may be mentioned, for example, partial esters of polyhydric alcohols such as neopentyl glycol monolaurate, trimethylolpropane monolaurate and glycerin monoleate.

The lubricating oil composition of the present invention may afford a high metal to metal friction coefficient and an excellent wear resistance because of the conjoint use of the specific phosphorus-containing compound and specific amine compound. Hence, the lubricating oil composition of the present invention may be suitably used as a lubricating oil composition for continuously variable transmissions, and may be particularly preferably used in metal belt type (push-belt type and chain type) continuously variable transmissions or toroidal type continuously variable transmissions.

EXAMPLES

The present invention will be next described in more detail by way of examples. The scope of the present invention is, however, not limited to these examples in any way.

The measurement of the friction coefficient and evaluation of the wear resistance were carried out using the following methods.

Measurement of Friction Coefficient:

Testing device: Ball on plate reciprocating tribometer (Cameron Plint TE77)

(Ball: SUJ2, 6 Mm Diameter, Plate: Scr420, Ra 0.6 μm)

Test Conditions

[Break-in conditions] 7N, 13 minutes

[Actual test]

Load: 7 N to 34 N (increased by 1 N per every 3 minutes)

Amplitude: 5 mm

Frequency: 22 Hz

Average sliding speed: 0.22 m/s

Oil temperature: 100° C.

Evaluation of Wear Resistance:

The wear scar diameter was measured using an optical microscope after the friction coefficient measuring test.

Examples 1 to 7 and Comparative Examples 1 to 9

Lubricating oil compositions containing the components shown in Table 1 were prepared. Each of the compositions was measured for its friction coefficient and evaluated for its wear resistance. The unit of the numerals shown in Table 1 is % by mass based on the total mass of the composition. As the lubricant base oil, a hydroreformed mineral oil (kinematic viscosity at 100° C.: 4.4 $mm^2/s$; viscosity index: 127) was used.

Phosphorus, nitrogen and calcium concentrations of the lubricating oil compositions, friction coefficients at 7 N, 21 N and 34 N and wear scar diameters thereof are shown in Table 2. In the present measurement, when the measured values at three loads are all 0.104 or more, the composition is regarded as providing satisfactory metal to metal friction coefficient. The desired value of the friction scar diameter is 0.27 mm or less.

TABLE 1-1

| | Example | | | | | | |
|---|---|---|---|---|---|---|---|
| | 1 | 2 | 3 | 4 | 5 | 6 | 7 |
| Base oil | Balance | Balance | Balance | Balance | Balance | Balance | Balance |
| Polymethacrylate: Mw 30,000 | 5.0 | 5.0 | 5.0 | 5.0 | 5.0 | 5.0 | 5.0 |
| Mono-n-butyl acid phosphate (C4) | — | — | — | — | 0.34 | — | — |
| Mono-2-ethylhexylacid phosphite (C8) | — | — | — | 0.25 | — | — | — |
| Mono-2-ethylhexylacid phosphate (C8) | 1.0 | 0.5 | 0.17 | 0.25 | — | 0.5 | 0.5 |
| Lauryl acid phosphate (C12) | — | — | — | — | — | — | — |
| Stearyl acid phosphate (C18) | — | — | — | — | — | — | — |
| Thiophosphoric acid ester | — | — | — | — | — | — | — |
| Tri-n-octyalamine | 1.14 | 0.57 | 0.19 | 0.57 | 0.57 | — | — |
| Tri-n-hexylamine | — | — | — | — | — | 0.43 | — |
| Tri-n-decylamine | — | — | — | — | — | — | 0.71 |
| Mono-n-octylamine | — | — | — | — | — | — | — |
| Triethylamine | — | — | — | — | — | — | — |
| Tributylamine | — | — | — | — | — | — | — |
| Tridodecylamine | — | — | — | — | — | — | — |

TABLE 1-1-continued

| | Example | | | | | | |
|---|---|---|---|---|---|---|---|
| | 1 | 2 | 3 | 4 | 5 | 6 | 7 |
| Triethylenetetramine ($H_2N[C_2H_4NH]_3H$) | — | — | — | — | — | — | — |
| Perbasic Ca sulfonate | 0.2 | 0.2 | 0.2 | 0.2 | 0.2 | 0.2 | 0.2 |
| Phenol-based antioxidant (DBPC) | 0.5 | 0.5 | 0.5 | 0.5 | 0.5 | 0.5 | 0.5 |
| Oleic monoglyceride | 0.2 | 0.2 | 0.2 | 0.2 | 0.2 | 0.2 | 0.2 |
| Copper deactivator (thiadiazole) | 0.05 | 0.05 | 0.05 | 0.05 | 0.05 | 0.05 | 0.05 |
| Deformer (silicone) | 0.2 | 0.2 | 0.2 | 0.2 | 0.2 | 0.2 | 0.2 |

TABLE 1-2

| | Comparative Example | | | | | | | | |
|---|---|---|---|---|---|---|---|---|---|
| | 1 | 2 | 3 | 4 | 5 | 6 | 7 | 8 | 9 |
| Base oil | Balance | Balance | Balance | Balance | Balance | Balance | Balance | Balance | Balance |
| Polymethacrylate: Mw 30,000 | 5.0 | 5.0 | 5.0 | 5.0 | 5.0 | 5.0 | 5.0 | 5.0 | 5.0 |
| Mono-n-butyl acid phosphate (C4) | — | — | — | — | — | — | — | — | — |
| Mono-2-ethylhexylacid phosphite (C8) | 0.5 | — | — | — | — | — | — | — | — |
| Mono-2-ethylhexylacid phosphate (C8) | — | 0.5 | 0.5 | 0.5 | 0.5 | 0.25 | — | — | 0.5 |
| Lauryl acid phosphate (C12) | — | — | — | — | — | — | 0.68 | — | — |
| Stearyl acid phosphate (C18) | — | — | — | — | — | — | — | 0.84 | — |
| Thiophosphoric acid ester | — | — | — | — | — | 0.7 | — | — | — |
| Tri-n-octyalamine | — | — | — | — | — | — | 0.57 | 0.57 | — |
| Tri-n-hexylamine | — | — | — | — | — | — | — | — | — |
| Tri-n-decylamine | — | — | — | — | — | — | — | — | — |
| Mono-n-octylamine | — | 0.57 | — | — | — | — | — | — | — |
| Triethylamine | — | — | 0.57 | — | — | — | — | — | — |
| Tributylamine | — | — | — | 0.57 | — | — | — | — | — |
| Tridodecylamine | — | — | — | — | 0.57 | — | — | — | — |
| Triethylenetetramine ($H_2N[C_2H_4NH]_3H$) | — | — | — | — | — | 0.1 | — | — | — |
| Perbasic Ca sulfonate | 0.2 | 0.2 | 0.2 | 0.2 | 0.2 | 0.2 | 0.2 | 0.2 | 0.2 |
| Phenol-based antioxidant (DBPC) | 0.5 | 0.5 | 0.5 | 0.5 | 0.5 | 0.5 | 0.5 | 0.5 | 0.5 |
| Oleic monoglyceride | 0.2 | 0.2 | 0.2 | 0.2 | 0.2 | 0.2 | 0.2 | 0.2 | 0.2 |
| Copper deactivator (thiadiazole) | 0.05 | 0.05 | 0.05 | 0.05 | 0.05 | 0.05 | 0.05 | 0.05 | 0.05 |
| Antifoaming agent (silicone) | 0.2 | 0.2 | 0.2 | 0.2 | 0.2 | 0.2 | 0.2 | 0.2 | 0.2 |

TABLE 2-1

| | Example | | | | | | |
|---|---|---|---|---|---|---|---|
| | 1 | 2 | 3 | 4 | 5 | 6 | 7 |
| Phosphorus concentration (% by mass) | 0.12 | 0.06 | 0.02 | 0.06 | 0.06 | 0.06 | 0.06 |
| Nitrogen concentration (% by mass) | 0.04 | 0.02 | 0.005 | 0.02 | 0.02 | 0.02 | 0.02 |
| Calcium concentration (% by mass) | 0.03 | 0.03 | 0.03 | 0.03 | 0.03 | 0.03 | 0.03 |
| Friction coefficient (Load 7 N) | 0.107 | 0.105 | 0.105 | 0.107 | 0.107 | 0.106 | 0.105 |
| Friction coefficient (Load 21 N) | 0.113 | 0.111 | 0.110 | 0.113 | 0.112 | 0.112 | 0.112 |
| Friction coefficient (Load 34 N) | 0.115 | 0.113 | 0.113 | 0.115 | 0.115 | 0.114 | 0.113 |
| Ball wear scar diameter (mm) | 0.258 | 0.261 | 0.264 | 0.268 | 0.264 | 0.268 | 0.266 |

TABLE 2-2

| | Comparative Example | | | | | | | | |
|---|---|---|---|---|---|---|---|---|---|
| | 1 | 2 | 3 | 4 | 5 | 6 | 7 | 8 | 9 |
| Phosphorus concentration (% by mass) | 0.06 | 0.06 | 0.06 | 0.06 | 0.06 | 0.06 | 0.06 | 0.06 | 0.06 |
| Nitrogen concentration (% by mass) | — | 0.06 | 0.08 | 0.04 | 0.015 | 0.04 | 0.02 | 0.02 | — |
| Calcium concentration (% by mass) | 0.03 | 0.03 | 0.03 | 0.03 | 0.03 | 0.03 | 0.03 | 0.03 | 0.03 |
| Friction coefficient (Load 7 N) | 0.106 | 0.095 | 0.102 | 0.096 | 0.095 | 0.096 | 0.085 | 0.078 | 0.096 |
| Friction coefficient (Load 21 N) | 0.110 | 0.100 | 0.107 | 0.102 | 0.100 | 0.102 | 0.090 | 0.084 | 0.102 |

TABLE 2-2-continued

| | Comparative Example | | | | | | | | |
|---|---|---|---|---|---|---|---|---|---|
| | 1 | 2 | 3 | 4 | 5 | 6 | 7 | 8 | 9 |
| Friction coefficient (Load 34 N) | 0.113 | 0.102 | 0.109 | 0.105 | 0.102 | 0.104 | 0.091 | 0.087 | 0.104 |
| Ball wear scar diameter (mm) | 0.334 | 0.254 | 0.315 | 0.273 | 0.285 | 0.262 | 0.296 | 0.258 | 0.368 |

As will be appreciated from Table 2, the lubricating oil composition of the present invention shows both a high metal to metal friction coefficient and an excellent wear resistance. In the case of Comparative Examples 1 to 6 and 9 in which no tertiary amine compound used in the present invention is used, on the other hand, the desired performances in friction coefficient and wear resistance are not achieved. In the case of Comparative Examples 7 and 8, in which no phosphorus-containing compound used in the present invention is used, the friction coefficient and wear resistance are no good.

Thus, when tertiary amine compound and phosphorus-containing compound are each specified and when the specified compounds are used conjointly, it is possible to achieve both a high metal to metal friction coefficient and an excellent wear resistance.

INDUSTRIAL APPLICABILITY

According to the present invention a lubricating oil composition having both a high metal to metal friction coefficient and an excellent wear resistance is obtainable. Because of the above characteristics, the lubricating oil composition is particularly suitably used in continuously variable transmissions.

The invention claimed is:

1. A lubricating oil composition comprising a base oil which comprises a mineral oil and/or a synthetic oil, and, compounded therein, (A) at least one phosphorus-containing compound selected from the group consisting of mono-n-butyl acid phosphate, mono-2-ethylhexylacid phosphite, and mono-2-ethylhexyl acid phosphate, and (B) at least one tertiary amine compound selected from the group consisting of tri-n-hexylamine and tri-n-decylamine, wherein a phosphorus content of the phosphorus-containing compound of component (A) is 0.02%-0.12% by mass based on the total mass of the lubricating oil composition;

a nitrogen content of the tertiary amine compound of component (B) is 0.005%-0.04% by mass based on the total mass of the lubricating oil composition, and a mass ratio of said phosphorus content of the phosphorus-containing compound of component (A) to said nitrogen content of the tertiary amine compound of component (B) is 3:1 to 4:1.

2. The lubricating oil composition as recited in claim 1, wherein said phosphorus content of the phosphorus-containing compound of component (A) is 0.03% to 0.09% by mass based on the total mass of the lubricating oil composition.

3. The lubricating oil composition as recited in claim 1, wherein said nitrogen content of the tertiary amine compound of component (B) is 0.02% to 0.04% by mass based on the total mass of the lubricating oil composition.

4. The lubricating oil composition as recited in claim 1, and comprising, further compounded therein, (C) at least one alkaline earth metal compound selected from the group consisting of alkaline earth metal sulfonates, alkaline earth metal phenates and alkaline earth metal salicylates.

5. A lubricating oil composition for a continuously variable transmission, comprising the lubricating oil composition according to claim 1.

6. A continuously variable transmission comprising the lubricating oil composition for a continuously variable transmission according to claim 5.

7. The lubricating oil composition as recited in claim 1, comprising mono-2-ethylhexyl acid phosphate as (A) and tri-n-hexylamine as (B).

8. The lubricating oil composition as recited in claim 4, comprising an alkaline earth metal salt of an alkylaromatic sulfonic acid obtained by sulfonating an alkylaromatic compound having a molecular weight of 300 to 1,500.

9. The lubricating oil composition as recited in claim 1, wherein said base oil consists of mineral oil.

10. The lubricating oil composition as recited in claim 1, wherein said lubricating oil composition does not comprise a phosphorus-containing compound other than one or more of said mono-n-butyl acid phosphate, mono-2-ethylhexylacid phosphite, and mono-2-ethylhexyl acid phosphate.

11. The lubricating oil composition as recited in claim 1, comprising tri-n-decylamine.

12. The lubricating oil composition as recited in claim 1, comprising mono-2-ethylhexyl acid phosphate and tri-n-decylamine.

13. The lubricating oil composition as recited in claim 1, comprising tri-n-hexylamine.

* * * * *